US005644886A

United States Patent [19]

Ekmark et al.

[11] Patent Number: 5,644,886

[45] Date of Patent: Jul. 8, 1997

[54] ROOFING

[75] Inventors: Ellert Ekmark, Hjortstigen 21, S-731 42 Köping; Erik Salomonsson, Kungsör, both of Sweden

[73] Assignee: Ellert Ekmark, Koping, Sweden

[21] Appl. No.: 360,430

[22] Filed: Dec. 21, 1994

[30] Foreign Application Priority Data

Oct. 31, 1994 [SE] Sweden ..... 9403726

[51] Int. Cl.[6] ..... E04D 3/362; E04D 1/00

[52] U.S. Cl. ..... 52/518; 52/519; 52/520; 52/526; 52/539

[58] Field of Search ..... 52/518, 519, 520, 52/526, 529, 535, 537, 539

[56] References Cited

U.S. PATENT DOCUMENTS

| | | | |
|---|---|---|---|
| 362,118 | 5/1887 | Sagendorph | 52/519 |
| 364,072 | 5/1887 | Wightman | 52/519 |
| 4,015,391 | 4/1977 | Epstein et al. | 52/520 |
| 4,272,576 | 6/1981 | Britson | 52/519 X |
| 4,308,702 | 1/1982 | Rajewski | 52/519 |
| 4,432,181 | 2/1984 | Funaki | 52/519 X |
| 4,736,565 | 4/1988 | Bisson | 52/526 |
| 4,878,331 | 11/1989 | Taylor | 52/519 |
| 4,934,120 | 6/1990 | Boyd | 52/518 |
| 5,174,092 | 12/1992 | Haden | 52/519 X |
| 5,249,402 | 10/1993 | Crick et al. | 52/520 X |

*Primary Examiner*—Wynn E. Wood
*Attorney, Agent, or Firm*—Young & Thompson

[57] ABSTRACT

A rectangular roof element is provided in the form of a sheet-like material which is bent back towards an upper surface thereof at an upper edge to provide a first hook and which is bent back towards an opposite lower surface at an opposite lower edge to provide a second hook. One side edge includes a gutter and an opposite side edge includes a stepped portion. The hooks, gutter and stepped portion are configured such that a plurality of similar roof elements may be joined together by mating first and second hooks of respective adjacent roof elements, and also mating gutters and stepped portions of respective adjacent roof elements.

8 Claims, 3 Drawing Sheets

ROOFING

Figure 1:
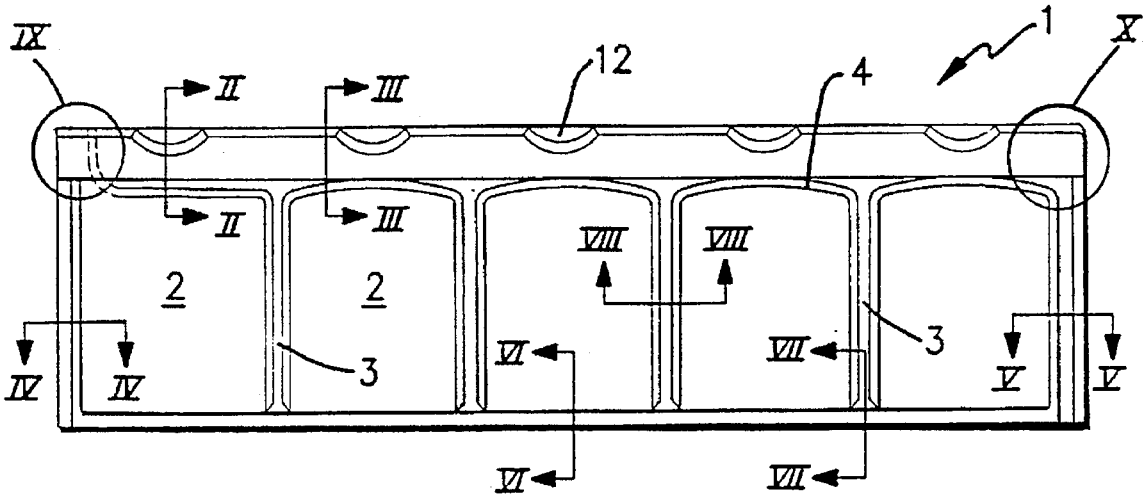

The present invention relates to roofing, and more specifically to separate elements of sheet material or sheeting material, preferably sheet metal, intended for being assembled to form a complete roofing.

Sheet metal has become an increasingly common roofing material. The reason for this is that sheet metal is a material of a relatively low weight, while being durable, easy to assemble and capable of adapting various shapes, shapes that are typical to the material, as well as imitating previously well-known roofing materials, such as roofing tile, shingle etc. Although the invention is disclosed as being related to sheet metal, it should be appreciated that other sheet or sheeting materials may be utilized with the same result, e.g. reinforced plastic.

A problem in connection with roofing assembled by separate elements that has proved to be difficult to solve in an easy way, is the provision of joints that easily permit assembling the different elements and, in spite of its readily achieved assembling operation, without constituting any significant risk of water penetrating during rainy weather, not even in connection with hard winds.

Another problem is related to securing the elements, so as to prevent them from falling off or having their joints opened during severe weather conditions, such as squalls and the like.

The most typical sheet metal roofing is the so called corrugated sheet metal, i.e. pieces of sheet metal having longitudinal, parallel crests, which are arcuate or present some other cross section. The crests all have the same shape, size and distance to one another, so that the sheet metal pieces may be entirely or partially superposed onto one another, thereby matching one another. In order to prevent water from penetrating through the joints, a large amount of overlapping is often required, this resulting in an excessive consumption of material. In many cases, the application of a sealing agent in the overlap joints will be required.

In order to reduce the number of joints, the separate elements have been made relatively large. In turn, this has made the elements cumbersome and heavy when handled.

Securing of the separate sheet metal elements is achieved by nailing or screwing, the nails or screws having to be placed such as to extend through the upwardly facing crests in order to prevent water flowing in the furrows between the crests from penetrating adjacent to the nails or screws. However, it is hard to avoid that the nails or the screws are driven in or screwed too far, deforming the sheet metal and making the joints leak. There is no such holding-up between the upwardly projecting crests and the underlayer, roof or batten that is capable of absorbing the forces of the assembly. Nor are the sheet metal elements of this type provided with any prefabricated fastener holes, but these holes will have to be made at the site, preferably through drilling. The holes are likely to be inaccurate, rate, and consequently there is always a risk of having a poor and leaky securing of these well-known roofing sheets to the underlayer.

Recently, roofing sheets have been developed, which are embossed in various ways, giving the impression of e.g. tile roofing. Regardless of the appearance, the same problems nevertheless apply as for the overlap at the joints in order to accomplish sealing and a satisfactory securing. In addition, the "pattern alignment" may call for an excessive overlap at the joints and, consequently, for an excessive consumption of material.

In many countries, bituminized paper is used as a roofing material. In order to obtain an aesthetical pattern, these are placed as panes, shingles, the overlapping being very large, partly because of the staggered joints and partly in order to accomplish a reliable seal. An overlap of appr. 50% to 80% is common in this type of roofing material. Bituminized paper roofing is relatively inexpensive and easy to put in place, but has a short life tame, between 5 and 10 years. After this time period, the roofing will have robe replaced. Thus, this type of roofing is relatively expensive, when considered on a long-term The object of the present invention is to provide a roofing, which, while eliminating the problems mentioned above, consists of separate elements, which permits an easy putting in place, which is leakproof, which presents a low amount of overlap, and which, in the long run, is not more expensive than other well-known roofing materials, e.g. shingled bituminized paper. The object is achieved by means of a roofing of sheet metal or similar sheet material or sheeting material, as set out in the claims, which also indicate the particular features of the invention.

Figure 2:
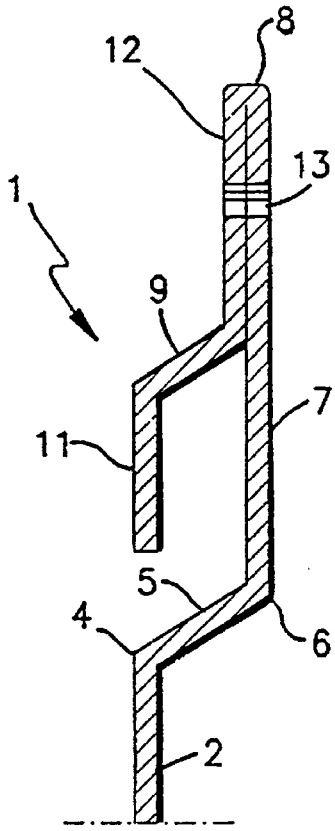
Figure 3:
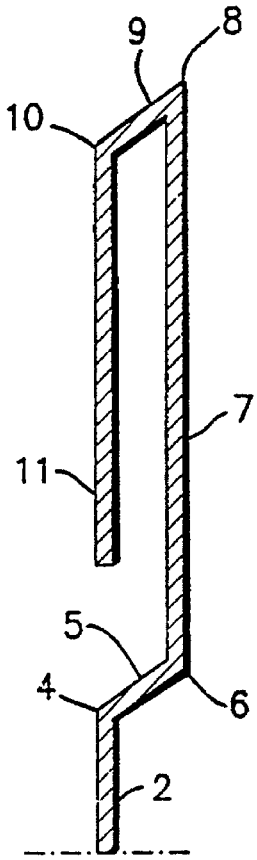
Figure 4:
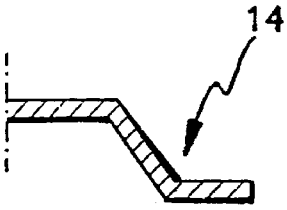
Figure 5:
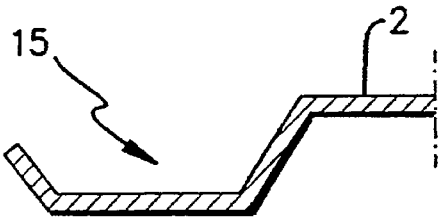
Figure 6:
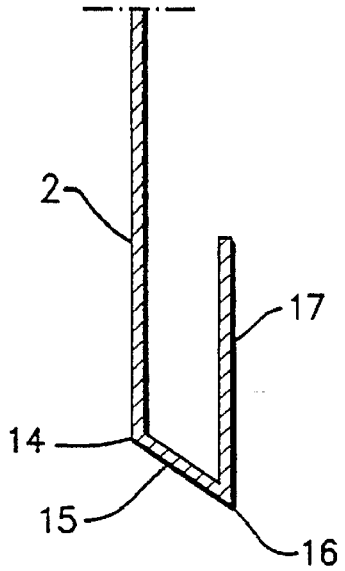
Figure 7:
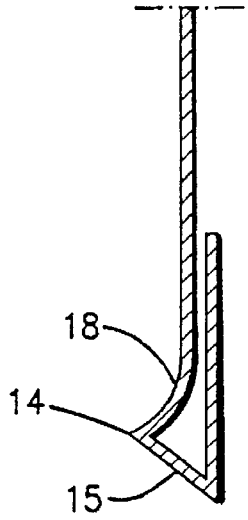
Figure 8:
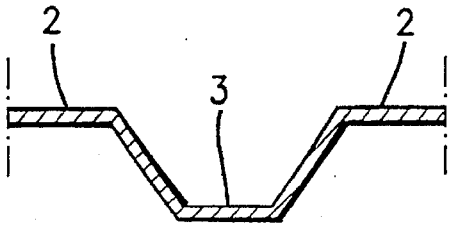
Figure 9:
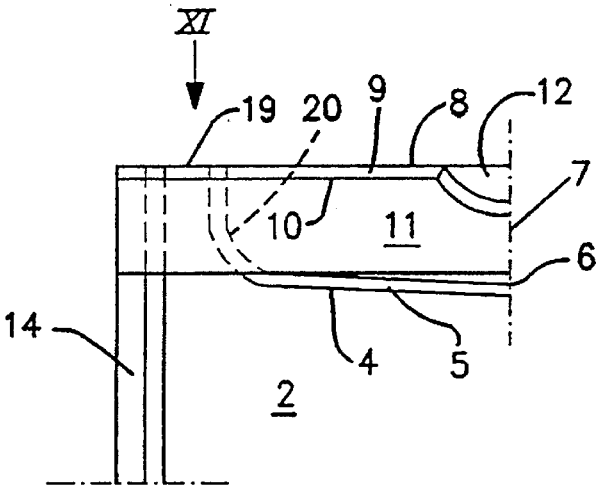
Figure 10:
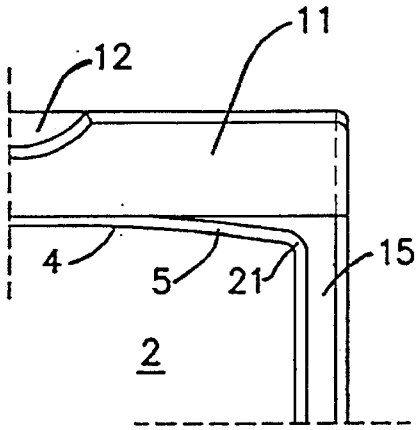
Figure 11:
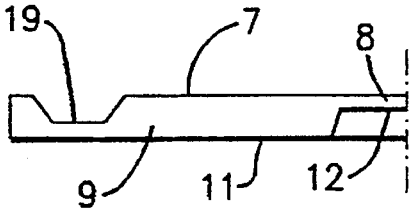
Figure 12:
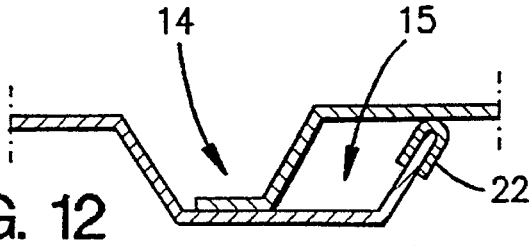
Figure 13:
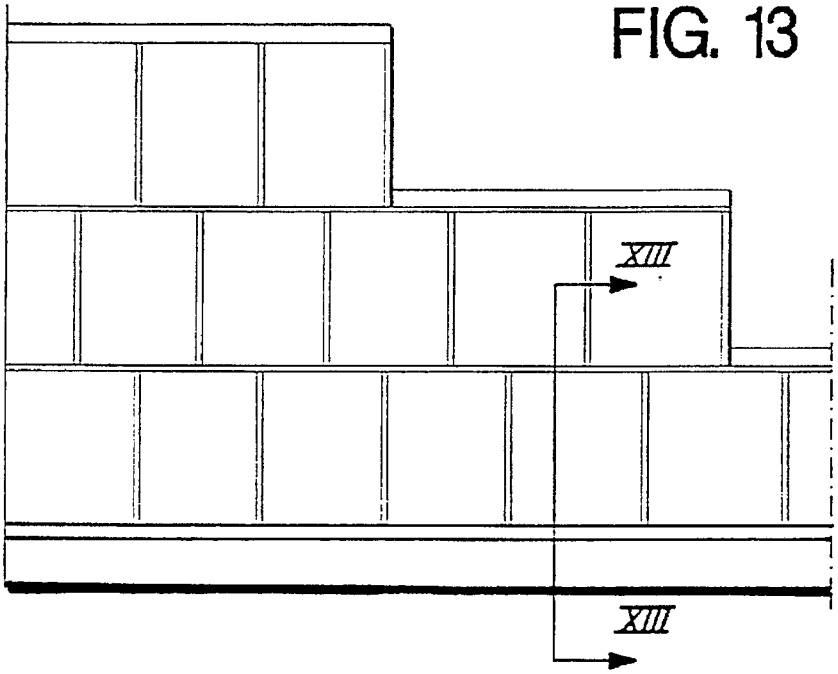
Figure 14:
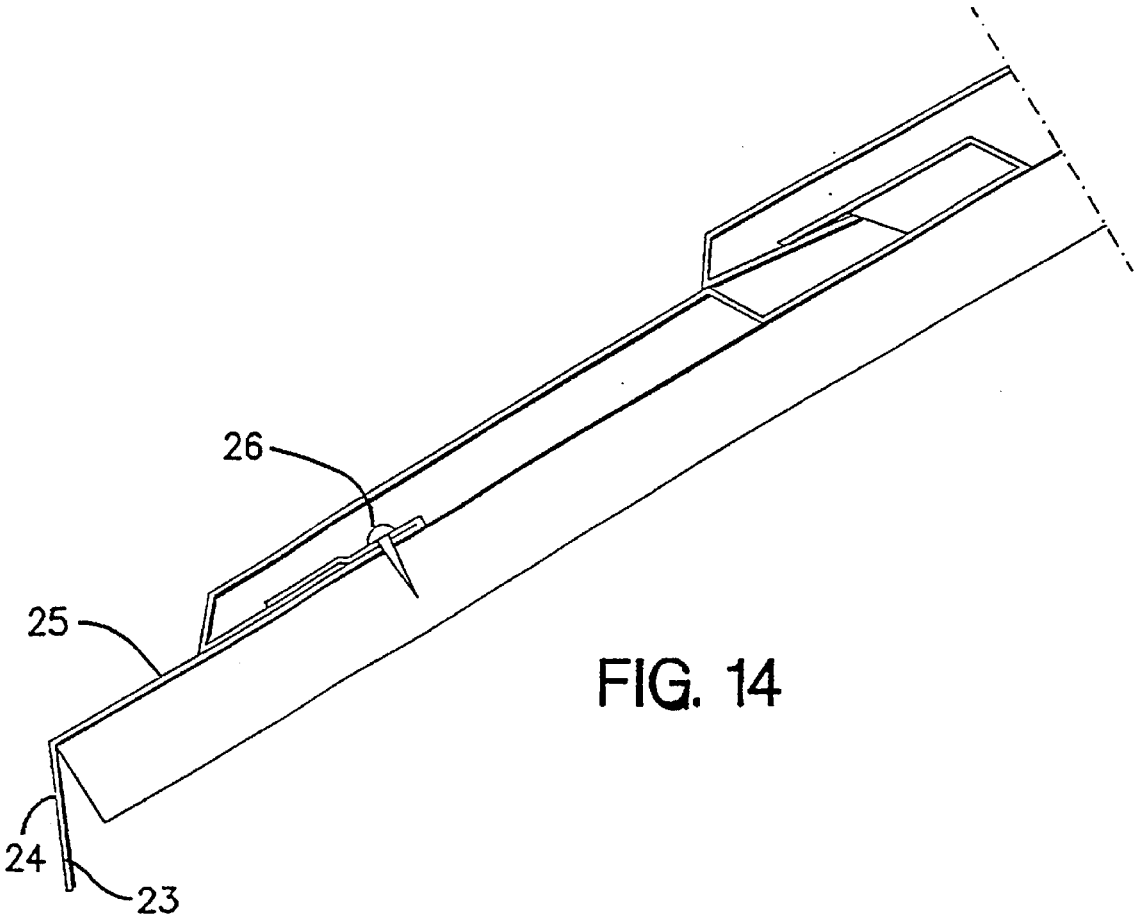

Below, the invention will be described more in detail and with reference to the appending drawings, wherein FIG. 1 is a view from above showing a roofing element of the invention, FIG. 2 is a broken out cross section taken along the line II—II of FIG. 1, FIG. 3 is a broken out cross section taken along the line III—III of FIG. 1, FIG. 4 Is a broken out cross section taken along the line IV—IV of FIG. 1, FIG. 5 is a broken out cross section taken along the line V—V of FIG. 1, FIG. 6 is a broken out cross section taken along the line VI—VI of FIG. 1, FIG. 7 is a broken out cross section taken along the line VII—VII of FIG. 1, FIG. 8 is a broken out cross section taken along the line VIII—VIII in FIG. 1, FIG. 9 is a broken out and partially transparent view taken within the ring IX of FIG. 1, FIG. 10 is a broken out view taken within the ring X of FIG. 1, FIG. 11 is a broken out view taken according to the arrow XI of FIG. 9, FIG. 12 is a broken out cross section through a joint between two interconnecting roofing elements, FIG. 13 is a broken out view from above of a roofing having roofing elements in accordance with the invention, and FIG. 14 is a broken out cross section taken along the line XIII—XIII of FIG. 13.

FIG. 1 shows a view from above of a separate roofing element 1 of sheet metal and designed in accordance with the invention. Primarily for aesthetical reasons, the rectangular element 1 is subdivided in a sequence of panes 2, which are spaced from one another through vertical grooves 3, and which give the element 1 the appearance of comprising smaller units, so called shingles. As stated, the invention is, however, utilizable in many different types of aesthetical designs of the elements 1 in order to give the roofing an attractive appearance. Further, the elements may, obviously, have various colors and various surface structures.

At the one horizontal longitudinal side, which is directed towards the ridge upon mounting on a roof, the sheet metal is folded over in the manner shown in FIG. 2 and 3, having a sectional shape, which is similar to a hook. In the vicinity of the portion having panes 2, the sheet metal element 1 is folded longitudinally along a line 4, which extends from one short end of the element 1 to the other one, in a direction towards the underlayer, preferably the roof, against which the sheet metal element 1 is intended to rest, thereby forming a step 5. Following the step 5, the sheet metal element 1 is once again folded in parallel to the line 4 to form a plane portion 7, which in turn is substantially parallel to the element 1 portion, which is provided with panes 2, and in a direction leading away from the element. Beginning at the portion 7, a folding along a line 8 and also in parallel to the folding 4 is accomplished leading away from the underlayer, so that a step 9 corresponding to the step 5 is formed. A back folding is provided along a line 10, which is also parallel to the line 4, thereby forming a tongue 11. The tongue 11 is substantially parallel to the opposite plane portion 7 and terminates a short distance away from the line 4.

Exactly in front of each pane 2, a minor compression 12 is provided, thereby inwardly displacing the step 9 at each such compression across a distance towards the free edge of the tongue 11 and giving it a somewhat arcuate shape, as shown An FIG. 1. A portion of the tongue 11 will then be pushed against the plane portion 7 and a hole 13 is provided through the tongue 11 and the plane portion 7 for inserting fasteners for the element 1.

At the one short end of the element 1, the short end being arranged vertically following the mounting of the element 1, a step 14, which is folded down, is provided, as shown in FIG. 4. This step extends from the upper longitudinal side of the element 1 to its lower longitudinal side. At the other short end of the element 1, a channel or gutter is formed by depression, said gutter also extending from the upper longitudinal side of the element 1 to its lower longitudinal side. As two elements are assembled in a sequence along each other, the step 14 will be placed in the gutter 15.

At the other longitudinal side of the element 1, which side, the element being mounted, is intended to be downwardly directed towards the edge of the roof, a folding over of a general hook shape is provided, where the sheet metal element 1 is folded towards the underlayer from the side having panes 2 along a line 14, which is parallel to the longitudinal sides of the element 1. From the line 14, a plane step 15 extends, at an obtuse angle in relation to the side having panes 2 to a folding line 16, which is parallel to the folding line 14, and from which a tongue 17 extends back under and substantially in parallel to the side having panes 2.

When mounting elements 1 one above another on a roof, the tongue 17 is placed to the inside of the tongue 11. At this time, the tongue 17 has a length such that it will abut the wall 9 at the compressions 12, provided that the mounting is correct, the folding line 16being located a few millimeters below the folding line 4, so that a small overlap is obtained.

The grooves 3 subdividing the element 1 into shingles, are embossed in the sheet metal element 1 from the step 5 to the folding line 14, its portion closest to the line 14 being smoothly outwardly curved, such as at 18 of FIG. 7. FIG. 8 shows a preferred cross section of such a groove 3.

FIG. 9 and 10, respectively, show the upper corners of an element 1 as well as the folding over described in connection with FIG. 2 and 3. In the upper left corner of the shown embodiment of the element 1, an embossing 19, see FIG. 11, t s provided for receiving the right portion of the element 1 lying to the left during mounting. Clearly, the designs to the left and to the right may be mirror-inverted. The embossing 19 is made so as to have a rounded, smooth transition 20 to the line 4 and the step 5. Correspondingly, to the right there is a rounded, smooth transition 21 made from the line 4 and the step 5 to the gutter 15.

The mounting of two elements 1 next to each other produces a joint of the kind shown in FIG. 12. Since the gutter 15 has a comparatively wide bottom, and since the step 14 is relatively small, there is a possibility of making certain adjustments in connection with the lateral matching of elements. In order to enhance the sealing quality and to prevent chafing damage, a U-shaped sealing strip 22 may be threaded onto the outer free edge at the gutter 15, at the location where this edge rests against the underside of the element to the right.

The assemblage of elements 1 according to the invention and in order to form a roofing is shown in FIG. 13 and 14. Here, it should be noted that the elements 1 may be mounted sequentially in so called lengths in stock beginning from the one side of the roof, the left side in the illustrated embodiment, to its other side, to the right, where it is cut, provided that the lengths do not fit, after which the next layer starts with the cut-off piece. In the case where the pattern alignment makes it necessary, a certain amount of matching may be needed before putting the first layer in place, this in turn possibly calling for a certain amount of matching of the following layers. In the illustrated embodiment, the roof imitating a shingle roof, a possibly required shortening will never exceed one half of a pane 2, this being neglectable for a surface as large as that of a roof.

At the lower edge. of the roof, a drip sheet 23 having a conventional drip 24 and a piece 25 are secured, the piece extending up along the roof. At the upper longitudinal side thereof, there is a folding over, which corresponds to what is illustrated in FIG. 2 and 3. Evenly spaced, fasteners 26 in the form of nails or screws are driven through the drip sheets 23 and into the roof for a safe retention hereof. A row of elements 1 are hooked by the tongues 17 under the tongues 11 to a position, where the free ends of the tongues 17 abut against steps 9 at the compression 12. In this position, the elements 1 are correctly mounted, on top of each other as well as along each other. For retention purposes, nails or screws-are driven through the holes 13 and into he underlying roof.

The water flowing down the roof mainly flows along the total extension thereof, i.e. across the plane portions as well as in the grooves and in the gutters down to the drip sheet 23, where the drip 24 takes the water away from the roof and, suitably, down to a gutter. In a case where water penetrates into the longitudinal joints, it will flow in the channel formed by the walls 5 and 7, from which it will spread across the panes 2 and reach the grooves 3. Water, which is not directly spread in the stated manner, flows on to the nearest gutter 15, from which it will be spread as the water reaches the element 1 lying below.

Through the invention, there is thus provided a roofing comprising a limited number of parts, namely the elements 1 themselves, these being a staple commodity, and, secondly, the drip sheets, which are substantially fewer than the elements 1, but which nevertheless are required at the lower edge of the roof. Further, there is ridge boarding and barge boards, which may be conventional in all respects. Further, the mounting is very simple, the mounting cost thus being low, but it will nevertheless be safe because of the large number of securing points provided in the upper edge of the elements. Further, the bendings and the hooking together of the elements are such, that winds never may take hold thereof in order to start lifting the elements off a roof. The overlaps are small, resulting in a modest consumption of material. The drainage leads from one element to another, without permitting water to penetrate to any harmful extent into the joints to reach the roof underneath.

We claim:

1. A rectangular roof element, comprising a sheet-like material having an upper surface and an opposite lower surface, an upper edge and an opposite lower edge, and a side edge and an opposite side edge, a first segment which is bent back towards said upper surface at said upper edge to form a first hook which extends towards said opposite lower edge and substantially across a width of said upper surface from said side edge to said opposite side edge, a second segment which is bent back towards said opposite lower surface at said opposite lower edge to form a second hook which extends towards said upper edge and substantially across a width of said opposite lower surface from said side edge to said opposite side edge, said first segment having a mating configuration relative to said second segment, said side edge comprising a gutter which extends substantially from said upper edge to said opposite lower edge, and said opposite side edge comprising a stepped portion which extends substantially from said upper edge to said opposite lower edge, said gutter having a mating configuration relative to said stepped portion.

2. The rectangular roof element of claim 1 wherein said first hook comprises a first tongue having a first tongue surface which faces said upper surface, said first tongue surface being parallel to and spaced from said upper surface, a first step joining said first tongue to said upper surface, and further wherein said second hook comprises a second tongue having a second tongue surface which faces said opposite lower surface, said second tongue surface being parallel to and spaced from said opposite lower surface, a second step joining said second tongue to said opposite lower surface.

3. The rectangular roof element of claim 2 wherein said first tongue surface faces and is spaced from and parallel to a first segment of said upper surface, a second segment of said upper surface extending in a same plane as said first tongue and being joined to said first segment of said upper surface by a third step.

4. The rectangular roof element of claim 3 wherein said first segment comprises a plurality of compressions which are spaced across said width from said side edge to said opposite side edge, each compression of said plurality of compressions abutting an adjacent portion of said first segment of said opposite lower surface.

5. The rectangular roof element of claim 4 wherein an opening extends through each compression and adjacent portion of said first segment of said opposite lower surface.

6. The rectangular roof element of claim 4 wherein said second tongue has a length, measured from (a) a distal end of said second tongue to (b) a junction line between said second step and said second tongue, which is greater than a length, measured from (c) a junction line between said third step and said second segment of said upper surface and (d) a junction line between said first step and a compression.

7. The rectangular roof element of claim 1 wherein said first segment comprises an embossing which is adjacent and parallel to said stepped portion and directed towards said second tongue.

8. A rectangular roof element, comprising a sheet-like material having an upper surface and an opposite lower surface, an upper edge and an opposite lower edge, and a side edge and an opposite side edge, a first segment which is bent back towards said upper surface at said upper edge to form a first hook which extends towards said opposite lower edge and substantially across a width of said upper surface from said side edge to said opposite side edge, a second segment which is bent back towards said opposite lower surface at said opposite lower edge to form a second hook which extends towards said upper edge and substantially across a width of said opposite lower surface from said side edge to said opposite side edge, said first segment having a mating configuration relative to said second segment such that said first hook of said rectangular roof element is insertable under a second hook of a similar rectangular roof element in order to join the similar roof elements together at said upper edge of said rectangular roof element and an opposite lower edge of said similar rectangular roof element, said side edge comprising a gutter which extends substantially from said upper edge to said opposite lower edge, and said opposite side edge comprising a stepped portion which extends substantially from said upper edge to said opposite lower edge, said gutter having a mating configuration relative to said stepped portion such that said gutter of said rectangular roof element is interconnectable with a stepped portion of another similar rectangular roof element in order to join said rectangular roof element and said another similar rectangular roof element together at said side edge of said rectangular roof element and an opposite side edge of said another similar rectangular roof element.

* * * * *